US007156775B1

(12) United States Patent
Watry et al.

(10) Patent No.: US 7,156,775 B1
(45) Date of Patent: Jan. 2, 2007

(54) STARTING BLOCK WITH PEDAL MARKINGS

(75) Inventors: Jeffrey P. Watry, Penfield, IL (US); Mark W. Arends, Urbana, IL (US)

(73) Assignee: Gill Athletics, Inc., Champaign, IL (US)

( * ) Notice: Subject to any disclaimer, the term of this patent is extended or adjusted under 35 U.S.C. 154(b) by 202 days.

(21) Appl. No.: 10/764,255

(22) Filed: Jan. 23, 2004

Related U.S. Application Data

(60) Provisional application No. 60/443,689, filed on Jan. 29, 2003.

(51) Int. Cl.
*A63B 21/00* (2006.01)

(52) U.S. Cl. ..... 482/17; 482/17; 482/74; 254/390; 254/406

(58) Field of Classification Search ..... 482/14, 482/19, 74, 79, 80, 52, 54; 434/247
See application file for complete search history.

(56) References Cited

U.S. PATENT DOCUMENTS 3,244,421 A * 4/1966 Hanna ..... 473/273
4,089,519 A * 5/1978 Newton, Jr. ..... 482/19
4,544,160 A * 10/1985 Miner ..... 473/218
4,561,650 A 12/1985 Newton, Jr. ..... 482/19
D385,606 S 10/1997 Newton, Jr. ..... D21/199
6,342,029 B1 1/2002 Richards ..... 482/19
6,422,872 B1 * 7/2002 Outlaw ..... 434/247

FOREIGN PATENT DOCUMENTS

DE 3403759 A * 8/1985

OTHER PUBLICATIONS

Gill Athletics 2003 Catalog pp. 8-9, 2003.

* cited by examiner

*Primary Examiner*—Jerome Donnelly
(74) *Attorney, Agent, or Firm*—Philip L. Bateman

(57) ABSTRACT

A starting block is used by a runner in a track event. The starting block contains a rail and a pair of foot pedal assemblies, one assembly connected to the left side of the rail and one assembly connected to the right side of the rail. Each foot pedal assembly contains a pad having a width of about five to twelve inches upon which the runner's foot is placed. Each pad contains markings along its width to enable the runner to place his feet at precisely the desired width.

4 Claims, 6 Drawing Sheets

STARTING BLOCK WITH PEDAL MARKINGS

CROSS-REFERENCE TO RELATED APPLICATION

This application claims the benefit of U.S. Provisional Application Ser. No. 60/443,689, Jan. 29, 2003.

FIELD OF THE INVENTION

This invention relates to track and field equipment. More particularly, this invention relates to starting blocks.

BACKGROUND OF THE INVENTION

Track and field is a sport in which athletes compete in running, jumping, and throwing events. Most running events are held on oval tracks located either outdoors or indoors. The surface of the oval tracks is typically a synthetic material, although some outdoor tracks are still made of cinders or the like. In many running events, each runner starts the race from a crouched position with his feet against a starting block. A starting block is a piece of equipment having a rail portion with two foot pedals. When the race begins, the runner is able to push back against the starting block and accelerate faster than would be possible without the starting block. Each runner has his own preferred foot placement relative to the starting line so most starting blocks have an adjustment means that enable the foot pedals to move forward and backward along the rail.

A wide variety of starting blocks are available commercially. For example, the 2003 catalog of Gill Athletics, Inc. of Champaign, Ill. features ten different starting blocks. Other starting blocks are disclosed in the patent literature, including Newton, Jr., U.S. Pat. No. 4,561,650, issued Dec. 31, 1985; Newton, Jr., U.S. Pat. No. Des. 385,606, issued Oct. 28, 1997; and Richards, U.S. Pat. No. 6,342,029, issued Jan. 29, 2002. Some starting blocks contain markings which enable the angle of the foot pedal or the longitudinal distance between the foot pedals to be reset easily to a desired position. Some starting blocks contain patterns on the front surface of the foot pedals.

Despite the many starting blocks that are available commercially or have been disclosed, a demand still exists for a starting block with markings on the foot pedals that enable the runner to place his feet at precisely the desired width.

SUMMARY OF THE INVENTION

The general object of this invention is to provide an improved starting block. A particular object is to provide a starting block with markings on the foot pedals that enable a runner to place his feet at precisely the desired width.

I have invented an improved starting block. The starting block comprises a rail and a pair of foot pedal assemblies, one assembly connected to the left side of the rail and one assembly connected to the right side of the rail. Each foot pedal assembly comprises a pad having a width of about five to twelve inches upon which the runner's foot is placed. Each pad contains markings along its width to enable a runner to place his feet at precisely the desired width.

The starting block of this invention enables a runner to easily place his feet at precisely the desired width.

DETAILED DESCRIPTION OF THE INVENTION

Figure 1:
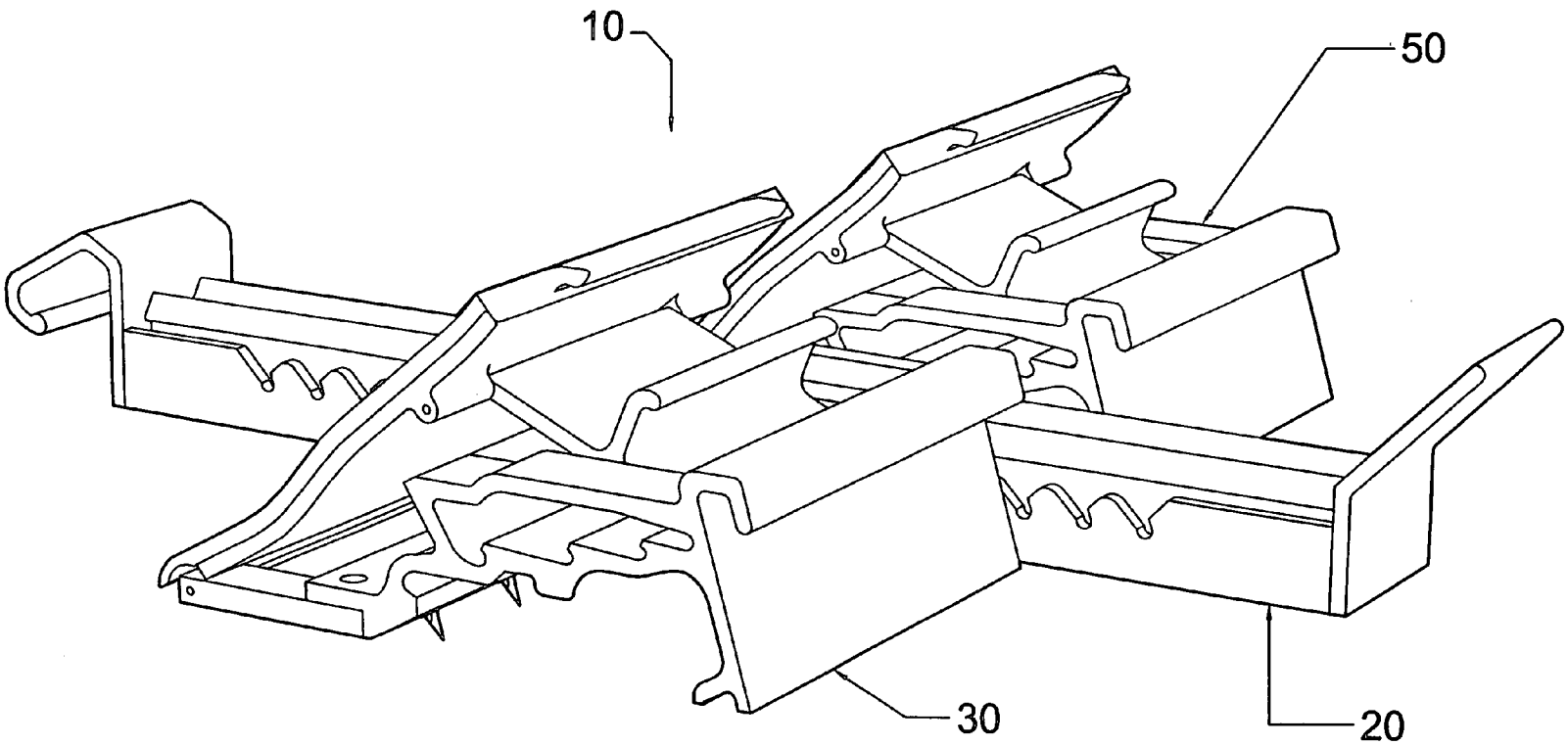
FIG. 1 is an upper left and rear perspective view of a preferred embodiment of the starting block of this invention.
Figure 2:
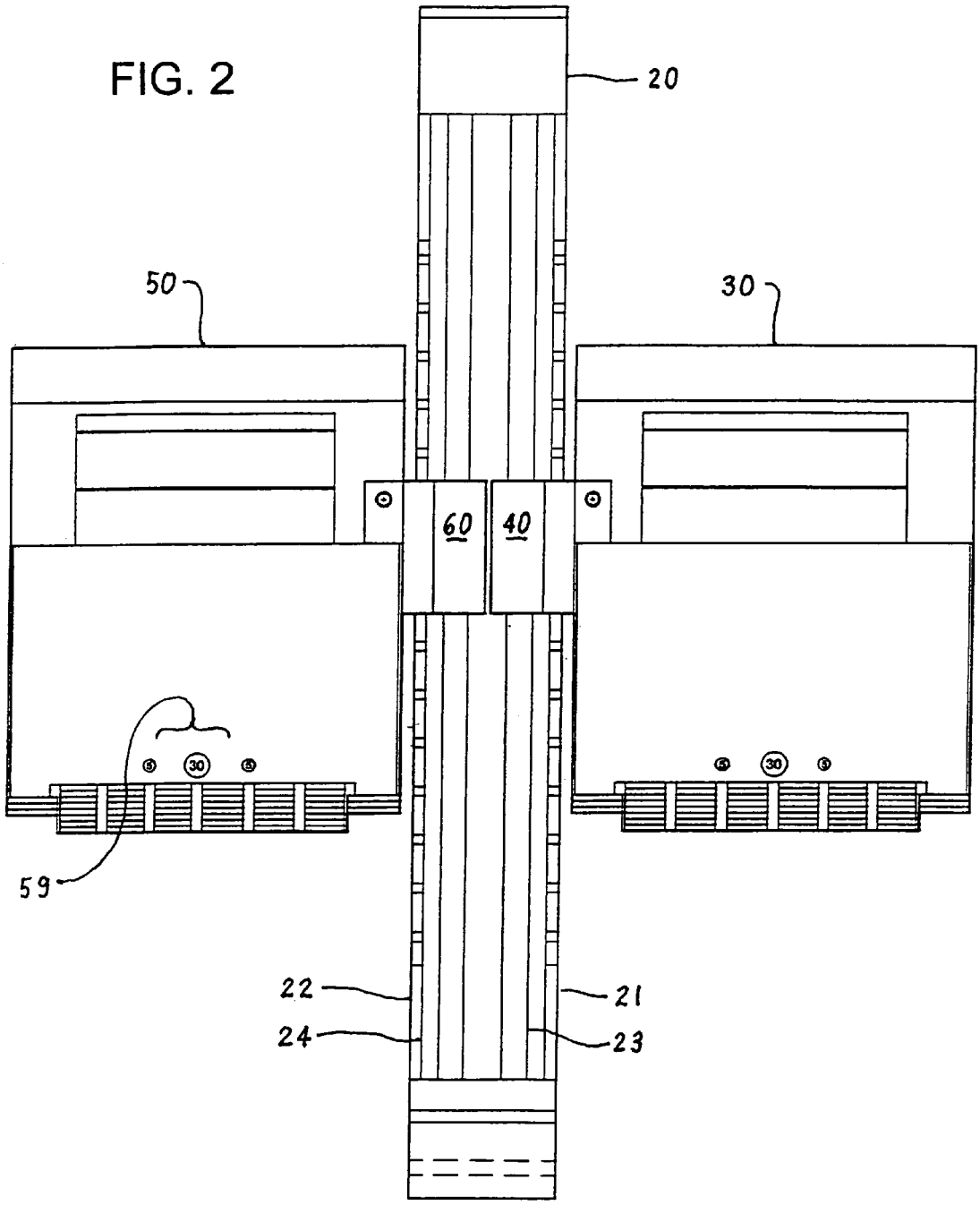
FIG. 2 is a top plan view thereof.
Figure 3:
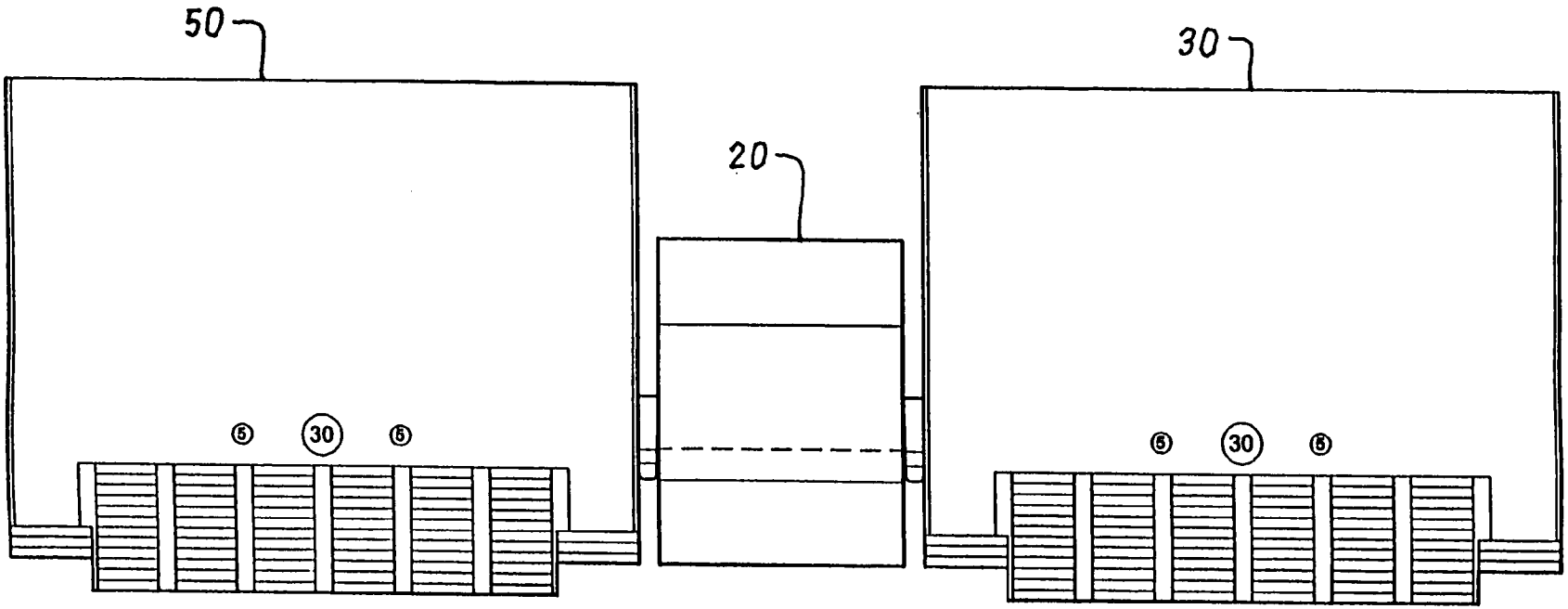
FIG. 3 is a front elevation view thereof.

This invention is best understood by reference to the drawings. A preferred embodiment of the starting block 10 of the present invention contains five components, a rail 20, a left foot pedal assembly 30, a left connector 40, a right foot pedal assembly 50 and a right connector 60. The components are preferably made of extruded aluminum for freedom from rust, light weight, and smooth operation during pedal adjustment. However, other materials, including steel, cast aluminum, and the like, are suitable. The five components are discussed in detail below.

The rail forms a link between the left foot pedal assembly and the right foot pedal assembly and enables them to be adjusted relative to each other along the length of the rail. The rail generally has a length of about one to four feet, preferably about two feet, and rests upon the track surface. The rail has two outwardly-positioned rows of teeth, one row 21 running along the left side and one row 22 running along the right side. The rail has two upwardly-projecting guides 23 and 24 that run parallel to and between the rows of teeth. Each guide resembles a wall with outward projections along its top surface that form an enlarged tip. In the preferred embodiment shown, the outward projections of the guide are opposing shoulders that angle upwards to join at a point forming the shape of an upwardly pointed triangle, similar in cross-section to that of a cone, an arrow, or a tree. However, other shapes for the outward projections are suitable, including rounded, square, and the like. The primary purpose of the outward projections is to retain the connectors as the foot pedals are moved. The outward projections also help to engage the connectors when the foot pedals are in the desired position. The front of the rail contains a handle 25 which is upwardly arching in shape. The rear of the rail contains a rearwardly-angled plate 26 which can be gripped when the starting block is being positioned on a track.

Figures 4, 5, 6:
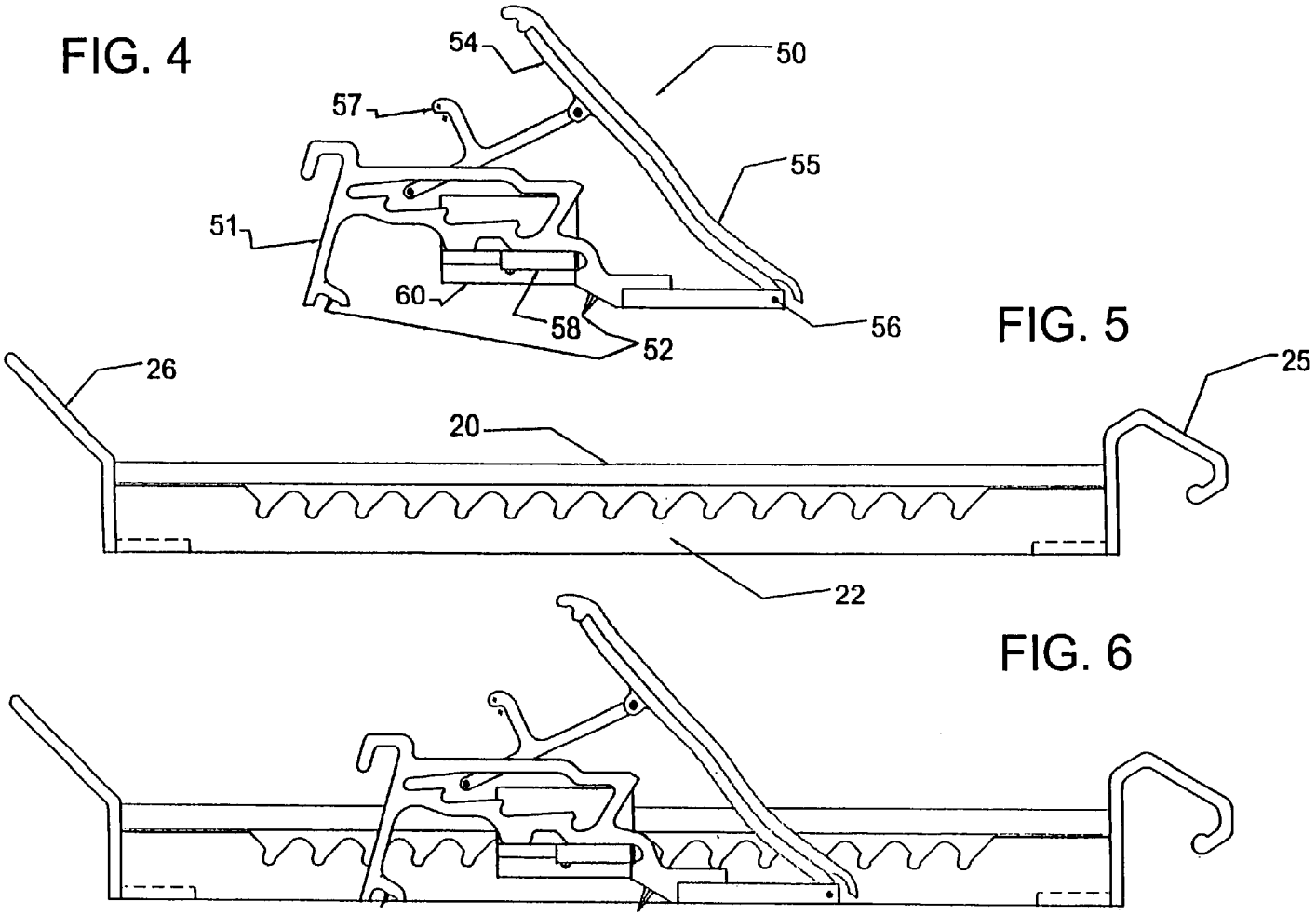
FIG. 4 is a side elevation view of the right foot pedal and the right connector.
FIG. 5 is a side elevation view of the rail.
FIG. 6 is a side elevation view of the right foot pedal connected to the rail.

The design of the left and right foot pedal assemblies is a matter of choice. Conventional foot pedal assemblies are suitable, but the preferred assembly is shown in the drawings. The left and right foot pedal assemblies are identical. For brevity, only the right foot pedal assembly shown in FIGS. 4 and 6 is discussed in detail. The right foot pedal assembly contains a frame 51 that rests upon the track surface. The frame contains downwardly and rearwardly directed spikes 52 that engage the track surface. The rearward direction of the spikes opposes the force exerted by the runner more precisely than conventional spikes which point straight downward. It is preferred that only the foot pedal assembly frames contain spikes. In other words, it is preferred that the rail not contain spikes. Spikes on the rail limit the rearward "setting" action that runners typically apply to the foot pedals before a race. The frame contains a plurality of steps 53 that, as discussed below, enable the reclining angle of the foot pedal to be adjusted.

The preferred right foot pedal assembly also contains a reclining foot pedal 54. The foot pedal is preferably contoured to more accurately conform to the shape of the runner's foot. A pad 55 made of a synthetic material is preferably mounted on the front surface of the foot pedal. The pad provides a cushioned surface that allows the spikes of the runner's shoes to engage. The foot pedal is pivotably connected to the frame at pivot point 56. A step member 57 is pivotably connected to the rear of the foot pedal. The step member selectively engages the steps of the frame to set the desired reclining angle of the foot pedal. The right foot pedal assembly preferably contains an integral tape measure 58 which enables the runner to measure the distance from the starting line to the foot pedal so that the pedal can be set in exactly the desired location.

The foot pedal generally has a width of about five to twelve inches, preferably about seven to ten inches, and most preferably about eight inches. It is believed that a wider foot placement enables a runner to more quickly achieve balance. This, in turn, increases acceleration and reduces the time to run the designated distance. The foot pedal contains markings 59 along the width of the pedal. The markings enable a runner to place his feet at precisely the desired width. The markings can indicate the distance from the center point of the rail, but preferably indicate double this distance which represents the distance between the feet. The markings are preferably in standard units of measurements such as centimeters (in the metric system) or inches (in the English system). In the preferred embodiment shown, a large marking indicates a separation of 30 centimeters. Smaller markings indicate separations of 25 and 35 centimeters. Even smaller markings indicate individual centimeter separations within this range.

Figure 7:
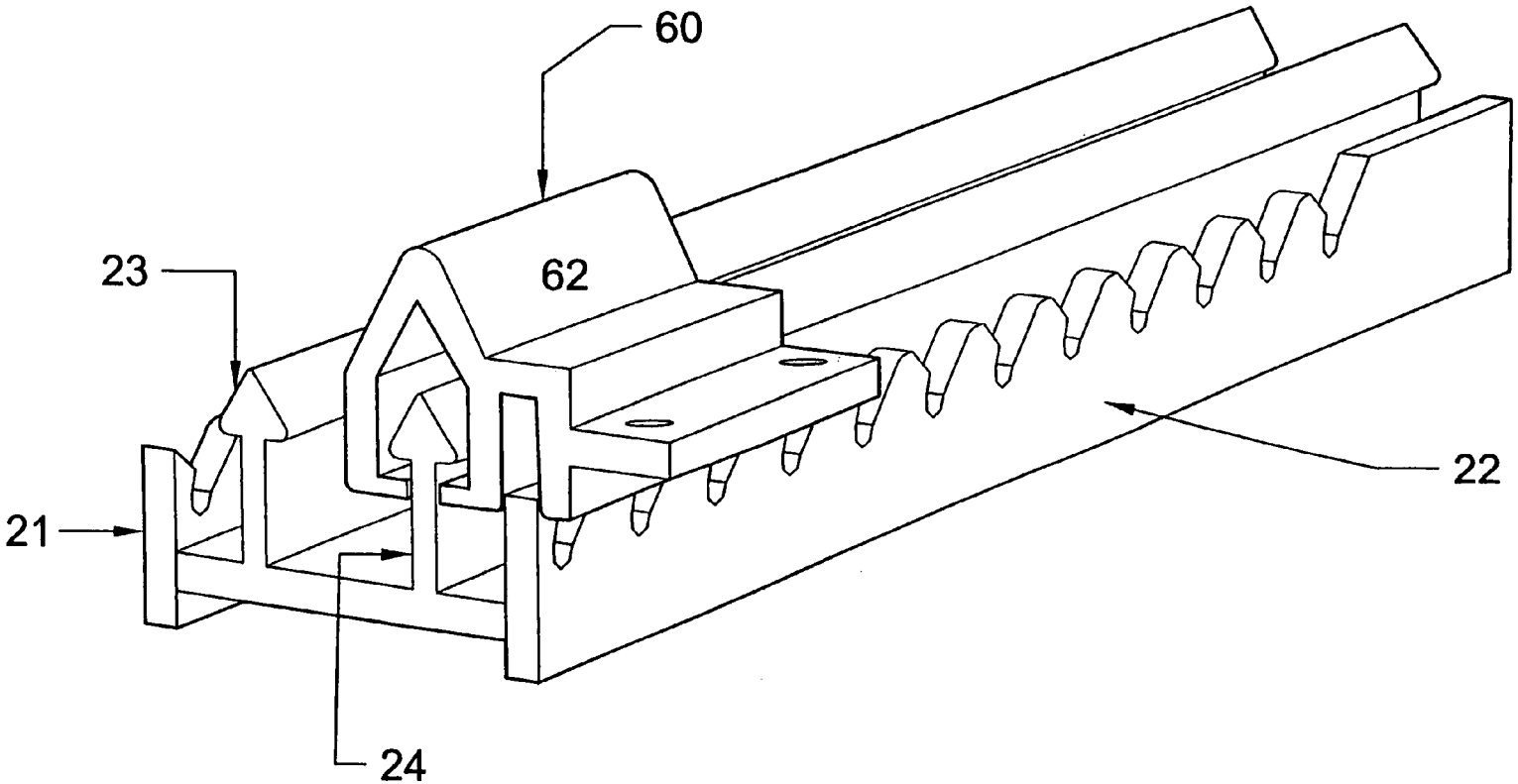
FIG. 7 is a rear perspective view, partially in section, showing a connector in the raised disengaged position on the rail.
Figure 8:
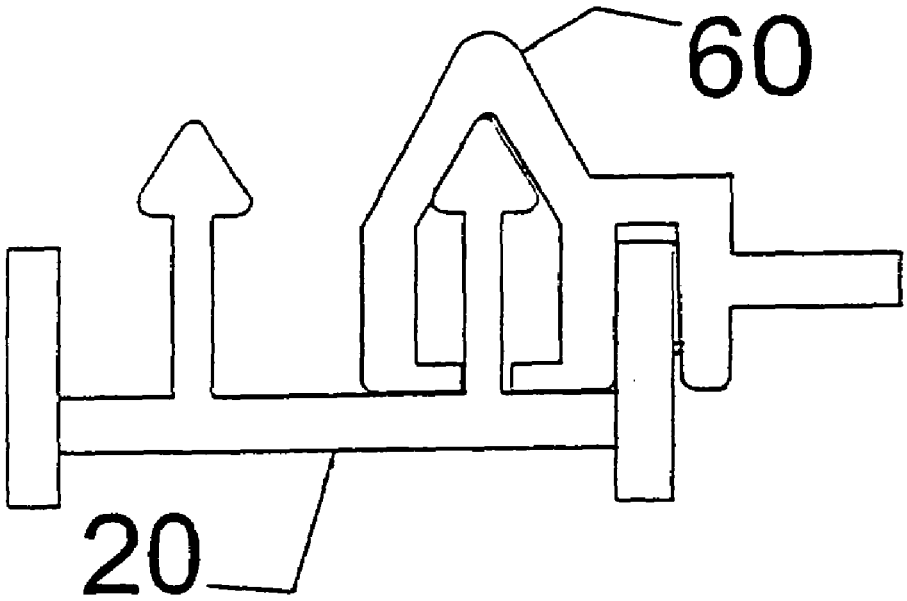
FIG. 8 is partial sectional rear view showing a connector in the lowered engaged position on the rail.
Figure 9:
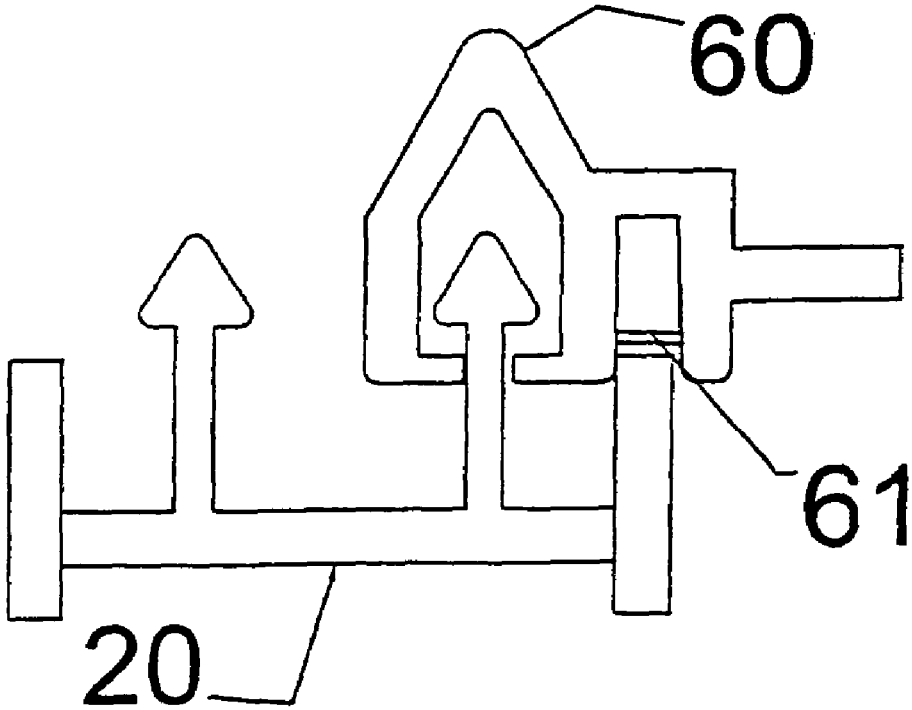
FIG. 9 is a partial sectional rear view showing a connector in the raised disengaged position on the rail.

The left and right connectors are mirror images of each other. In FIGS. 7 to 9, only the right connector is shown and the right foot pedal is omitted for clarity. For brevity, only the right connector is discussed in detail. The connector engages both its respective row of teeth and its respective guide of the rail. The teeth are engaged by an engaging member that is, in the preferred embodiment, a pin 61. The pin nestles down into the lowermost portion of the teeth when the connector is fully engaged as shown in FIG. 8. When the connector is raised and disengaged, as shown in FIGS. 7 and 9, the pin passes above the top of the teeth. The guide is engaged by a sleeve 62. The sleeve envelopes the guide except at the base of the guide. The sleeve rests upon the enlarged tip of the guide when the connector is fully lowered and engaged to provide additional stability and security. Accordingly, the inside upper surface of the sleeve is preferably of a size and shape that mates with the enlarged tip of the guide. When the connector is fully disengaged, the sleeve is retained on the guide by the enlarged tip, but otherwise makes minimal contact with the guide.

The use of the starting block of this invention is similar to the use of conventional starting blocks, but with the major advantage that the runner can place his feet at precisely the desired width.

We claim:

1. A starting block for a runner in a track event, the starting block comprising: (a) a rail; and (b) a pair of foot pedal assemblies, one assembly connected to the left side of the rail and one assembly connected to the right side of the rail, each foot pedal assembly comprising a pad having a width of about five to twelve inches upon which a runner's foot is placed, each pad comprising numerical distance markings in metric units or English units along its width to enable a runner to place his feet at precisely the desired width.

2. The starting block of claim 1 wherein the markings indicate the distance from the center point of the rail or the distance between the feet.

3. The starting block of claim 2 wherein the markings are molded into the surface of the pad.

4. The starting block of claim 3 wherein the markings indicate the distance between the feet in metric units.

* * * * *